US005274986A

United States Patent [19]

Gonzales

[11] Patent Number: 5,274,986

[45] Date of Patent: Jan. 4, 1994

[54] SELF-ADJUSTING, ORTHOPEDICALLY-CORRECT SADDLE AND SADDLE TREE THEREFOR

[76] Inventor: Steve R. Gonzales, 210 Golden West, Ojai, Calif. 93023

[21] Appl. No.: 797,135

[22] Filed: Nov. 21, 1991

[51] Int. Cl.[5] ..... B68C 1/02

[52] U.S. Cl. ..... 54/44.1; 54/44.4

[58] Field of Search ..... 54/44.1, 44.5, 44.7, 54/46.1, 44.4

[56] References Cited

U.S. PATENT DOCUMENTS

| | | | |
|---|---|---|---|
| 303,152 | 8/1884 | Hahn | 54/44.1 |
| 751,865 | 2/1904 | Martin | 54/46.1 |
| 2,353,622 | 7/1944 | Boyle | 54/44.1 |
| 3,835,621 | 9/1974 | Gorenschek | 54/44.7 |

*Primary Examiner*—Robert P. Swiatek
*Attorney, Agent, or Firm*—Donald A. Streck

[57] ABSTRACT

A statically and dynamically self-adjusting and orthopedically-correct saddle and tree which are also anatomically correct for a rider. There are a pair of flat first bars which support the weight distributed on the horse's back. There is also a seat portion comprising a seat and a cantel with a pair of flat second bars extending forward from the seat. The seat with the seat center positioned at a point under the center of gravity of a rider and over the low point in the horse's back. Elastomeric members connect the seat portion to the pair of first bars. A girth is attached to the seat portion by a connecting harness and a pair of stirrup straps are attached to respective ones of the pair of flat second bars at a distance in front of the center of gravity of a rider equal to a distance between the rider's ankle and the ball of the rider's foot. The padding material over the first bars adjacent the horse's back dynamically adjusts to the horse's back at times of greatest dynamic motion.

37 Claims, 7 Drawing Sheets

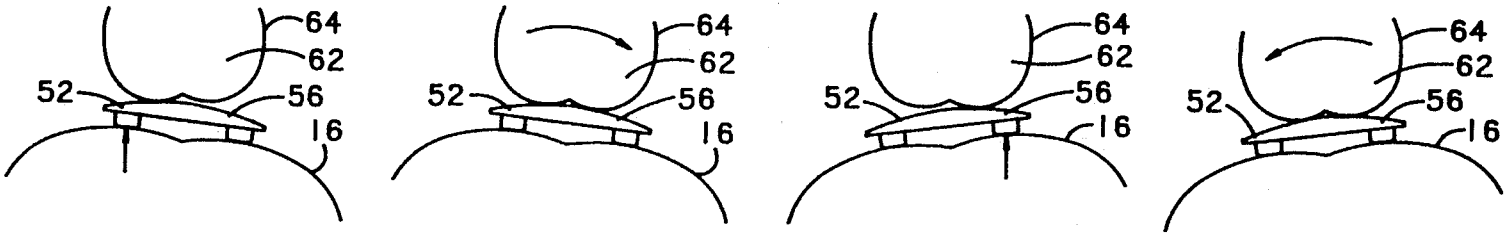
PRIOR ART
FIG. 9
PRIOR ART
FIG. 10
PRIOR ART
FIG. 11
PRIOR ART
FIG. 12
PRIOR ART
FIG. 13
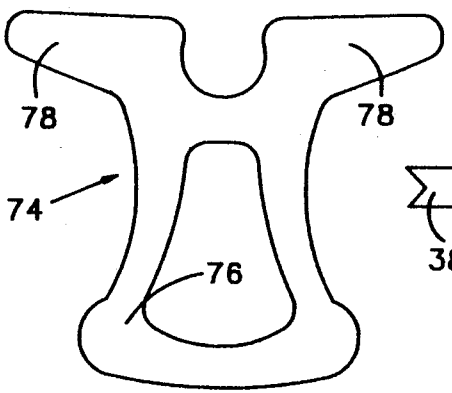
PRIOR ART
FIG. 14
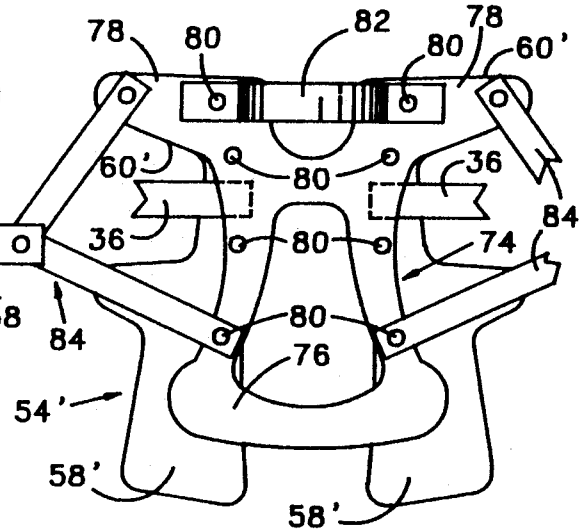
PRIOR ART
FIG. 15

SELF-ADJUSTING, ORTHOPEDICALLY-CORRECT SADDLE AND SADDLE TREE THEREFOR

BACKGROUND OF THE INVENTION

This invention relates to saddles used for riding horses and, more particularly, to a statically and dynamically self-adjusting and orthopedically-correct saddle comprising, a pair of flat resiliently-flexible first bars each having a rear portion disposed to lie on a horse's back along opposite sides of the horse's spine and generally parallel thereto and a front portion disposed to follow a curve from the rear portion down and alongside the horse's withers; a seat portion comprising a rear portion including a seat and a cantel and a front portion comprising a pair of flat resiliently-flexible second bars extending forward from the seat, the seat portion being positioned with the second bars disposed over and parallel to the front portion of respective ones of the first bars, the seat portion further being attached to the pair of first bars at respective first points located in the rear portion and respective second points located in the front portion, the seat being positioned in a middle one-third of the saddle with a center point thereof under a center of gravity of a rider sitting thereon and over a low point in the horse's back; a pair of first elastomeric members connecting the seat portion to the pair of first bars at respective ones of the second points; a pair of second elastomeric members connecting the seat portion to the pair of first bars at respective ones of the first points, the first elastomeric members and the second elastomeric members being of a silicone foam material; a girth; a pair of stirrup straps; means for attaching the girth to the saddle carried by the seat portion; and, means for attaching the pair of stirrup straps to respective ones of the pair of flat second bars at a distance in front of the center of gravity of a rider equal to a distance between the rider's ankle and ball of the rider's foot; wherein, the first elastomeric members and the second elastomeric members are annular in shape; and additionally comprising, retaining means passing through each of the first elastomeric members and the second elastomeric members for attaching and retaining the first elastomeric members and the second elastomeric members between the seat portion and the pair of first bars; and wherein additionally, each of the first bars is covered on a side facing the horse's back with, an under layer of a foam material adhesively bonded to the first bar, a layer of individual balls of unbonded upholstery material exhibiting the qualities of Dacron disposed over the under layer, a layer of neoprene disposed over the layer of individual balls of unbonded upholstery material to contain the layer of individual balls of unbonded upholstery material in a compartment formed of the layer of neoprene and the under layer of foam material, and an outside covering over the first bar on one side and over the layer of neoprene on an opposite side, whereby, as the horse's back flexes and moves in motion, the foam material and neoprene compressibility and restoratively move in response to dynamic motions of the horse's back and the balls of the unbonded upholstery material shift, move, and compress to fill in low places and thereby dynamically shape to the horse's back at times of greatest dynamic forces.

Except for the occasional bareback rider, most people riding horses employ a saddle. While people have ridden horses for different purposes for many years, the saddle itself has undergone very little change from the earliest saddles. Mostly, the few changes in saddles are the result of changes in material rather than any changes in the way the saddle and its supporting tree are designed. Unfortunately, those changes which have taken place are mostly esthetic changes to appeal to the rider's sense of perceived value. Virtually no consideration has been given to the comfort of the horse and little more given to providing the rider with the best platform from which to ride the horse.

Unlike the seat of an automobile or other vehicle which is mounted to a stable base and merely has to support the rider in a virtually static environment for long periods without causing pain or fatigue, a saddle for horseback riding is attached to a living and dynamically-active base, i.e. the back of a horse. As depicted in FIG. 1, the back of a horse 10 has a raised portion at the base of the neck at the withers 12, a low point at 14 (between the 14th and 18th vertebrae), and another raised portion at the rump 16. Opposite the horse's back is its belly 18. Horses come in all sizes and shapes. In some, the withers 12 is quite high and provides a well-defined ridge. In others, it is of little consideration with respect to saddle fit. While always present to some degree, in some horses, the low point 14 is almost unnoticeable while in a so-called "swayback" horse, it is a definite valley. Laterally, some horses have a flat back and in others the back is quite rounded.

As depicted in FIGS. 2 and 3, some of the first "saddles" were actually pack racks 20 employed to allow the horse 10 to carry loads strapped thereto. A pack rack 20 could be made by lashing a pair of X-members 22 to a pair of side bars 24. A blanket 26 was then placed on the horse's back for protection and the pack rack 20 fastened in place with a belly band 28. The load could then be tied to the X-members 22 to prevent it from falling off. The weight of the load was then distributed on the horse's back without impinging on the spine by the side bars 24. Later, the pack rack 20 was easily adapted to make a saddle by raising the side bars 24 slightly, attaching a seat to the side bars 24, and then throwing a blanket over it to add some padding for the rider.

A so-called Western saddle 30 as depicted in FIG. 4 evolved out of the foregoing background. The heart of the Western saddle 30 is the saddle tree 32; which, if one notes the construction thereof, is merely a modification of the pack rack of FIGS. 2 and 3. Early Western saddle trees 32 were made of wood fastened together and covered with rawhide which, when it dried, made the saddle tree 32 a rigid and virtually indestructible unit. While fiberglass has replaced the rawhide in some Western saddles, there are still many Western saddles being built today employing rawhide. In fact, for heavy duty use for cattle roping and the like, a saddle with a rawhide covered wooden saddle tree 32 is still the most durable and, for such uses, is an exception to the discussion herein and the present invention. As depicted in FIG. 4, the Western saddle 30 comprises leather coverings and skirts (indicated by the dashed lines 34) stitched over the saddle tree 32. The stirrups are hung from straps 36 attached to the tree 32 and the girth 38 (which replaced the pack rack's belly band) is attached to metal rings or slots (not shown) in the skirts 34.

The "fit" of a Western saddle 30 is generally a happenstance thing for the horse 10. Basically, the leather of the coverings and skirts 34 is somewhat stiff and some padding is placed between the leather and the tree 32. All in all, however, the pressure points are at the "legs" 40 of the tree 32. The forward part of the Western saddle 30 goes over the withers 12. Typically, the tree 32 of a Western saddle 30 is so long that place the weight of the rider (sitting on the back one-third of the saddle) is far to the rear of the low point 14 of the horse's back. If the horse is short in length of back, a rider in a large Western saddle 30 may actually be sitting up on the horse's rump 16. Between the shape of the saddle 30, the shape of the horse's back, the effects of gravity, and the effects of the horse's back moving and elongating in motion, the saddle 30 will tend to move to a "natural" settling point. If the saddle 30 appears to be of an improper fit, many corrective devices are available—virtually none of which take the horse's comfort into consideration. The most common form of "adjustment" (since no other is available) is to add more padding in the form of more or a thicker saddle pad 42. This usually has a detrimental effect as it adds thickness around the withers 12 in particular, thereby forcing the saddle 30 to the rear of the horse 10. If the saddle 30 tends to move to the rear from where the rider thinks it should be, a chest strap 44 is sometimes employed. To counteract forward movement (as in going downhill), a crupper 46 is sometimes connected from the saddle 30 around the base of the horse's tail. Working ropers often put on several saddle pads 42 (to protect the horse 10 in this case) and then may use all of the above plus a rear cinch strap 48 to prevent forward rotation of the saddle 30 when a large force is applied to the saddle horn 50 as during roping a large steer.

The English saddle 52 of FIGS. 5 and 6 was developed more for pleasure riding, showing, and jumping. While, like its Western counterpart, it comes in many varieties for specialized uses, the basic components are the same. Again, the heart is a saddle tree 32'. In this case, the saddle tree 32' comprises a pair of bars 54 connected by a seat 56. It may be of a unitary or separate component construction in this regard. The bars 54 (whether separate or integral) have rear portions 58 that lie along the back of the horse 10 on either side of the spine and front portions 60 which extend downward toward the front shoulders of the horse 10. The girth 38 and stirrup straps (or "leathers") 36 share a common point of attachment to the saddle tree 32' at the front thereof where the front portions 60 and the rear portions 58 meet. While not so prevalent with modern materials, in older English saddles the above-described construction was prone to breakage as the result of poor saddle fit and changes in the horse's shape during movement—particularly during jumping and running at the gallop wherein the horse's back it subject to extremes of extension. Since the bars 54 are joined only by the material of the seat 56 (and quite often were formed of the same piece of wood) and the girth 38 is attached at the front of the saddle tree 32', a wooden seat 56 could split lengthwise or the wooden seat 56 and bars 54 could break laterally from unsupported forces—particularly when landing from a jump with force on the stirrups pulling in opposite directions.

The problems of the above-described saddles and the saddle trees which support them are depicted in simplified form in FIGS. 7 through 12. As depicted in FIG. 7, the rump 16 and back of the horse 10 are wider than the buttocks 62 of the rider 64. The seat 56 is supported by the spaced bars 54 and the top of the seat 56 is curved to fit the curve of the horse 10. The rider 64 is supported by the muscles of the buttocks 62 in combination with the pelvic and leg bones at the two points indicated by the arrows 66. As a platform upon which to sit, therefore, the seat 56 is subjected to a lateral rocking motion as a result of the sides of the rump 16 of the horse 10 alternatingly moving up and down during gaits such as walking when the horse's rear legs clearly move separately. As depicted in FIG. 8, the front to back aspects of a rigid saddle as a platform upon which to sit are no better. The horse's front shoulder blades rise and fall as indicated by the arrow 68. The rump 16 rises and falls as indicated by the arrow 70. The back extends as indicated by the arrows 72. The back also arches and sideflexes. In particular, the back of a large racehorse (16–16½ hands high) may arch as much as three inches at full gallop. Since most show horses are not put into more than a slow cantor, realistically the major arch of consideration is more in the order of one inch; but, it is to be understood that a quarter of an inch of saddle mis-fit can cause extreme pain to a horse. In addition to potentially causing pain to the horse, from the rider's point of view all these dynamic movements of the horses back result in varying degrees of fore, aft, and lateral rocking motions of the saddle "platform" 52. The lateral rocking phenomenon during walking is depicted in greater detail in FIGS. 9–12. The left side of the rump 16 raises raising the left side of the saddle 52 as depicted in FIG. 9. Momentarily, the rider 64 is supported by the left side of his/her buttocks 62. The rider 64 then rolls to the right as depicted in FIG. 10 so as to gain bi-lateral support. This results in a rotation of the pelvis to the right accompanied by necessary adjustments to the back, shoulders, neck, and head. As depicted in FIGS. 11 and 12, the right side of the rump 16 then raises raising the right side of the saddle 52. Momentarily, the rider 64 is supported by the right side of his/her buttocks 62. The rider 64 then rolls to the left to again gain bi-lateral support. This results in a rotation of the pelvis to the left accompanied by the necessary adjustments to the back, shoulders, neck, and head. The process then repeats, and repeats, and repeats.

Twenty years ago, Matthias Gorenschek, a European saddle maker who had brought his craft to the United States some years previously, filed for a patent on what seems to be the first true attempt at changing the design and performance of a saddle employing contemporary materials—in particular, fiberglass. The Gorenschek saddle was ultimately patented in 1974 as U.S. Pat. No. 3,835,621. By building his saddle tree of fiberglass, Gorenschek hoped to gain flexibility and adaptability while greatly reducing the weight of the saddle (particularly with respect to a Western saddle wherein the saddle tree itself weighs several pounds). The elements of the Gorenschek saddle are shown in FIGS. 13–15. There are a pair of bars 54' somewhat like those of the English bars 54 (Gorenschek having been trained as a saddlemaker of English style saddles) only flat and of several layers of fiberglass cloth bonded with resin. Like the English bars 54, Gorenschek's bars 54' have rear portions 58' that lie along the back of the horse 10 on either side of the spine and front portions 60' which extend downward over the front shoulders of the horse 10. Being of fiberglass, the bars 54' can be shaped to more closely fit the shape of the horse in those areas and, therefore, hopefully distribute the weight more uniformly. The Gorenschek saddle was designed primarily with the comfort of the horse in mind (unfortunately, disregarding the anatomy of the rider in the process) and, therefore, each pair of bars 54' was preferably formed over a plaster cast of the back of the horse for which it was intended.

The other major component of the Gorenschek saddle was a seat portion 74. The seat portion 74 was also formed of fiberglass layers and consisted of a rear portion 76 comprising the seat and cantel of typical saddle shape and front portions 78 shaped to extend downward and fit over the front portions 60' of the bars 54'. The Gorenschek saddle tree was assembled as shown in FIG. 15 with the seat portion 74 attached to the bars 54' with screws, bolts, or rivets as at the points labelled 80. A front arch 82 of fiberglass was connected across the front portions 78 and also acted as a handle for carrying the saddle or for the mounting of a saddle horn 50. The girth 38 was attached by connecting straps 84 and the stirrup straps 36 were attached to the bars 54' behind the front portions 78 as shown. Padding in the form of conventional horsehair batting or the like and a leather covering stitched over the saddle tree of FIG. 15 completed the saddle. No saddle horn 50 and a plain leather covering closely shaped to the bars 54' and seat portion 74 produced a saddle more English in nature while a saddle horn 50 on the front arch 82 along with tooled leather and wider skirts and the like produced a more Western-looking version of the Gorenschek saddle.

While it was intended to be far and away a more horse-considerate saddle than its predecessors, unfortunately, the Gorenschek saddle fell short of being a saddle which fulfilled the needs of either the horse or the rider. The front portions 60' of the bars 54' are firmly attached to the front portions 78 of the seat portion 74 as with screws or bolts. Thus, the two front portions 60' and the two front portions 78 comprise two composite structures which are supposed to provide the desired flex and adaptability of the Gorenschek saddle. The idea being that when the right shoulder blade of the horse raised, the right front portions 60' and front portions 78, in combination, would flex upward and the remainder of the saddle would remain stable. The goal was a good one in theory; but, did not work when implemented. If the fiberglass of the bars 54' and the front portions 78 of the seat portion 74 are made thin enough to provide the required flexibility, they are too fragile and will crack from that flexing. If they are made thick enough to be durable, there is no flexibility and the Gorenschek saddle essentially acts like the old Western saddle tree 32 except for a better weight distribution and considerably reduced weight. The front arch 82 also tends to act counter to any potential flexibility which is realized. Being custom made for each horse, of course, the problems of even a rigid tree were greatly reduced. In other words, except for the added weight of the wood and rawhide or fiberglass, even a Western saddle tree 32 can be made to function much more acceptably if custom fitted to a particular horse.

The Gorenschek saddle was also based on the proposition that the best place for the saddle is high up on the withers. Thus, the shape and positioning of the bars 54' is made for that specific purpose. In essence, the Gorenschek saddle tree is like an inverted V intended to straddle the withers 12 of the horse 10. Moreover, the rear portions 58 of the bars 54' were not designed to lie parallel to the horse's spine; but rather, to aid in forcing the front portions 60 along the withers 12 and over the shoulder blades. Unfortunately, as will be discussed in more detail hereinafter, all saddles designed to be placed in a more-forward position ultimately work their way to their "natural" position (unless held in place with chest straps or the like)— and the Gorenschek saddle was no exception. When a saddle is forcibly retained in such a forward position over the withers 14, the result is pressure and pain to the shoulder blades of the horse. In addition to positioning the saddle and its components wrong for the anatomy and comfort of the horse, the Gorenschek saddle also positioned them wrong for the anatomy and correct riding posture of the rider. It didn't provide the rider with a centered position over the low point 14 of the horse's back or a stable and level platform upon which to sit. The stirrups were hung from the bars 54' which, in practice, proved to be a disaster as the bars 54' (being intentionally of a deformable nature—at least under sufficient force) would often twist and dig into the horse's back under the force of a heavy rider standing in the stirrups. The "correction" for this problem was more batting material under the point of contact—sometimes as much as four inches of added padding. This, of course, completely counteracted the attempted perfect fit for weight distribution and, in fact, created a localized pressure point at the point of added padding; and, raised the saddle high on an unstable supporting surface.

In all of the above-described prior art saddles, the rider's weight is typically located in the back one-third of the saddle. The attachment of the girth and stirrups, on the other hand, takes place in the front one-third of the saddle. In particular, the place of attachment of the stirrups has virtually no relationship to the center of gravity of the rider. Thus in standing in the stirrups, the rider is typically forced to move his/her center of gravity far forward from its position when seated in the saddle. In addition to often resulting in rider "wobble" while standing, this can also cause problems when using the stirrups and "leg-aids" to guide the horse through leg movements and pressures.

Wherefore, it is a primary object of this invention to provide a saddle design and saddle tree for the implementation thereof which is the most comfortable for the horse and minimizes any chance of causing injury or pain to the horse even during long periods under saddle.

It is another object of this invention to provide a saddle design and saddle tree for the implementation thereof which greatly reduces the effects of horse movement which are passed through to the rider.

It is yet another object of this invention to provide a saddle design and saddle tree for the implementation thereof which provides a more stabilized platform for the rider.

It is still another object of this invention to provide a saddle design and saddle tree for the implementation thereof which is orthopedically correct for the horse and anatomically correct for the rider.

It is a further object of this invention to provide a saddle design and saddle tree for the implementation thereof which automatically adjusts to the shape of the horse both statically and dynamically.

Other objects and benefits of the invention will become apparent from the detailed description which follows hereinafter when taken in conjunction with the drawing figures which accompany it.

SUMMARY

The foregoing objects have been achieved by the statically and dynamically self-adjusting and orthopedically-correct saddle and saddle tree upon which it is built of the present invention wherein the saddle comprises a pair of flat resiliently-flexible first bars each having a rear portion disposed to lie on a horse's back along opposite sides of the horse's spine and generally parallel thereto and a front portion disposed to follow a curve from the rear portion down and alongside the horse's withers; a seat portion comprising a rear portion including a seat and a cantel and a front portion comprising a pair of flat resiliently-flexible second bars extending forward from the seat, the seat portion being positioned with the second bars disposed over and parallel to the front portion of respective ones of the first bars, the seat portion further being attached to the pair of first bars at respective first points located in the rear portion and respective second points located in the front portion, the seat being positioned in a middle one-third of the saddle with a center point thereof under a center of gravity of a rider sitting thereon and over a low point in the horse's back; a pair of first elastomeric members connecting the seat portion to the pair of first bars at respective ones of the second points; a girth; a pair of stirrup straps; means for attaching the girth to the saddle carried by the seat portion; and, means for attaching the pair of stirrup straps to respective ones of the pair of flat second bars.

In the preferred embodiment, the means for attaching the pair of stirrup straps to respective ones of the pair of flat second bars attaches the pair of stirrup straps at a distance in front of the center of gravity of a rider equal to a distance between the rider's ankle and ball of the rider's foot.

Also in the preferred embodiment, there are a pair of second elastomeric members connecting the seat portion to the pair of first bars at respective ones of the first points. Preferably, the first elastomeric members and the second elastomeric members are of a silicone foam material. Where only the first elastomeric members are employed, the first elastomeric members are of a silicone foam material.

If desired, the elastomeric members can be adhesively attached to the seat portion and the pair of first bars.

Preferably, however, the elastomeric members are annular in shape and there are retaining means passing through each of the elastomeric members for attaching and retaining the elastomeric members between the seat portion and the pair of first bars.

For additional adjustability purposes, the elastomeric members can be made thinner adjacent a first edge than adjacent a second edge opposite the first edge whereby an angular relationship between the seat portion and the pair of first bars is adjustable by rotationally orienting the elastomeric members.

Preferably, the means for attaching the girth comprises a pair of metal hooks to which a girth billet is attached and the means for attaching the pair of stirrup straps comprises a pair of metal hooks to which stirrup leathers are attached.

Also preferably, each of the first bars is covered on a side facing the horse's back with an under layer of a foam material adhesively bonded to the first bar; a layer of individual balls of unbonded upholstery material exhibiting the qualities of Dacron disposed over the under layer; a layer of neoprene disposed over the layer of individual balls of unbonded upholstery material to contain the layer of individual balls of unbonded upholstery material in a compartment formed of the layer of neoprene and the under layer of foam material; and, an outside covering over the first bar on one side and over the layer of neoprene on an opposite side, whereby, as the horse's back flexes and moves in motion, the foam material and neoprene compressibility and restoratively move in response to dynamic motions of the horse's back and the balls of the unbonded upholstery material shift, move, and compress to fill in low places and thereby dynamically shape to the horse's back at times of greatest dynamic forces.

DESCRIPTION OF THE DRAWINGS

FIGS. 9–12 are simplified drawings in the manner of FIG. 7 depicting how the rider is rocked from side too side by the dynamic movements of the horse acting on a prior art saddle with a rigid saddle tree.

FIG. 13 is a detailed plan view drawing of the bar portions of a saddle tree for a prior art saddle which attempted to solve problems of saddles and saddle trees which were prior art to it at the time.

FIG. 14 is a detailed plan view drawing of the seat portion of the saddle tree of FIG. 13.

FIG. 15 is a detailed plan view drawing of the assembled prior art saddle tree of FIGS. 13 and 14.

DESCRIPTION OF THE PREFERRED EMBODIMENT

As those skilled in the art will readily recognize and appreciate, the processes of padding and covering a saddle tree to make a saddle therefrom of any particular style are well known to those skilled in the art. Therefore, in the interest of simplicity and the avoidance of redundancy, except for those padding and covering aspects of the saddle of the present invention which are novel and contribute to its achieving its stated objectives, the drawings and description of those aspects will not be addressed with any specificity herein and the major thrust will be towards the saddle tree itself. It will also be noted that the saddle described herein after is not of any particular style (i.e. Western or English). The saddle tree of the present invention can be employed to create a saddle in a particular style primarily through the shaping of the covering materials and the choice of the materials used. For example, the use of larger skirts in tooled leather will produce a saddle more Western in appearance to the observer. It is primarily intended by the inventor, however, that the saddle of this invention be employed in its basic form and that its "style" will stand on its own merits.

As will be seen from the description which follows, the saddle of the present invention achieves it stated objectives in a best mode through three different features—which, of course, can provide step improvements in prior art saddle design and construction when employed individually. For maximum horse comfort and to provide the anatomically correct platform for the rider, however, all three novel aspects of the present invention should be employed.

Figure 1:
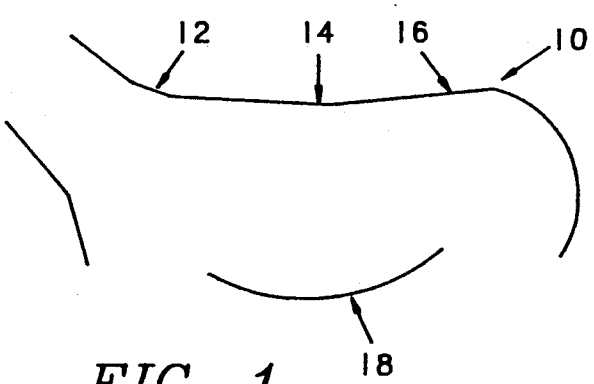
FIG. 1 is a simplified side view of a horse in the areas critical to saddle design and performance.
Figure 2:
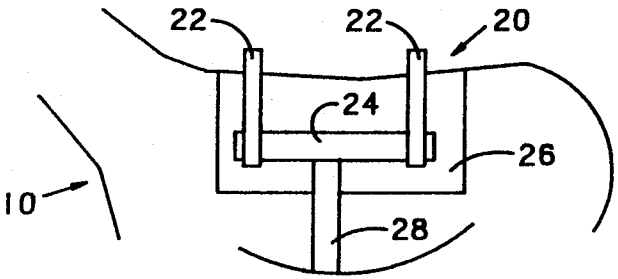
PRIOR ART FIG. 2
FIG. 2 is a simplified partial side view of a horse as in FIG. 1 showing the first prior art saddles as employed for pack horses.
Figure 3:
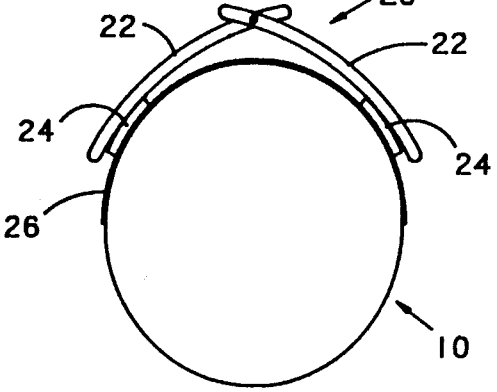
PRIOR ART FIG. 3
FIG. 3 is a simplified cross-sectional view of FIG. 2.
Figure 4:
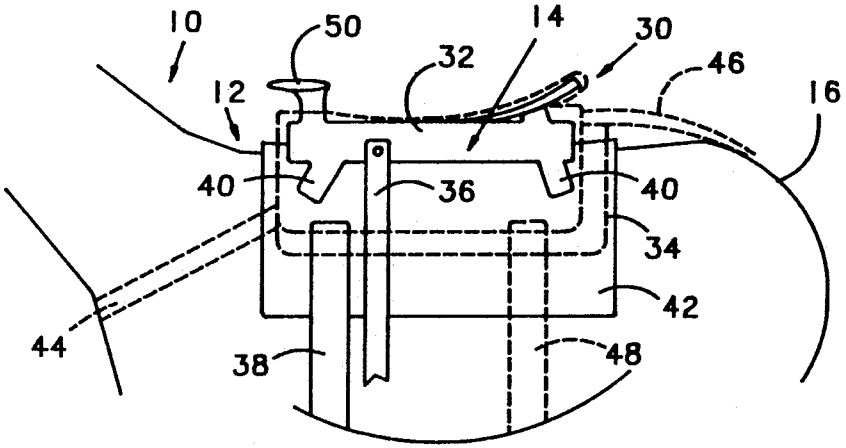
PRIOR ART FIG. 4
FIG. 4 is a simplified partial side view of a horse as in FIG. 1 showing a prior art Western type of saddle.
Figure 6:
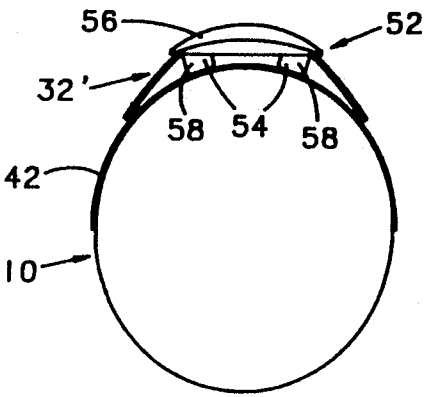
PRIOR ART FIG. 6
FIG. 6 is a simplified cross-sectional view of FIG. 5.
Figure 5:
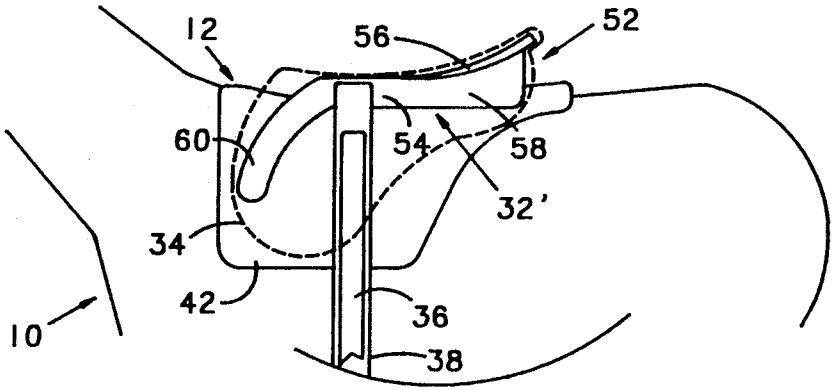
PRIOR ART FIG. 5
FIG. 5 is a simplified partial side view of a horse as in FIG. 1 showing a prior art English type of saddle.
Figure 8:
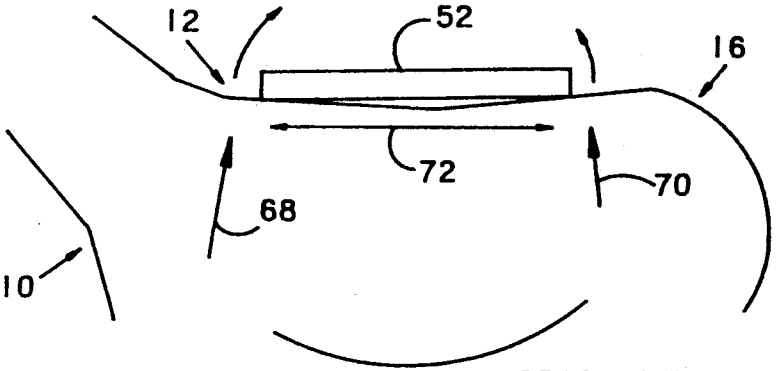
PRIOR ART FIG. 8
FIG. 8 is a simplified partial side view of a horse as in FIG. 1 depicting how a prior art saddle with a rigid saddle tree acts as a moving platform in relation to the dynamic movements of the horse.
Figure 7:
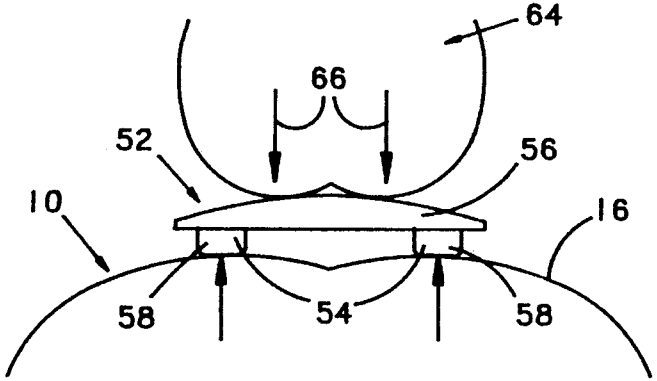
PRIOR ART FIG. 7
FIG. 7 is a simplified rear view of a rider on a prior art saddle sitting on a horse's back.
Figure 16:
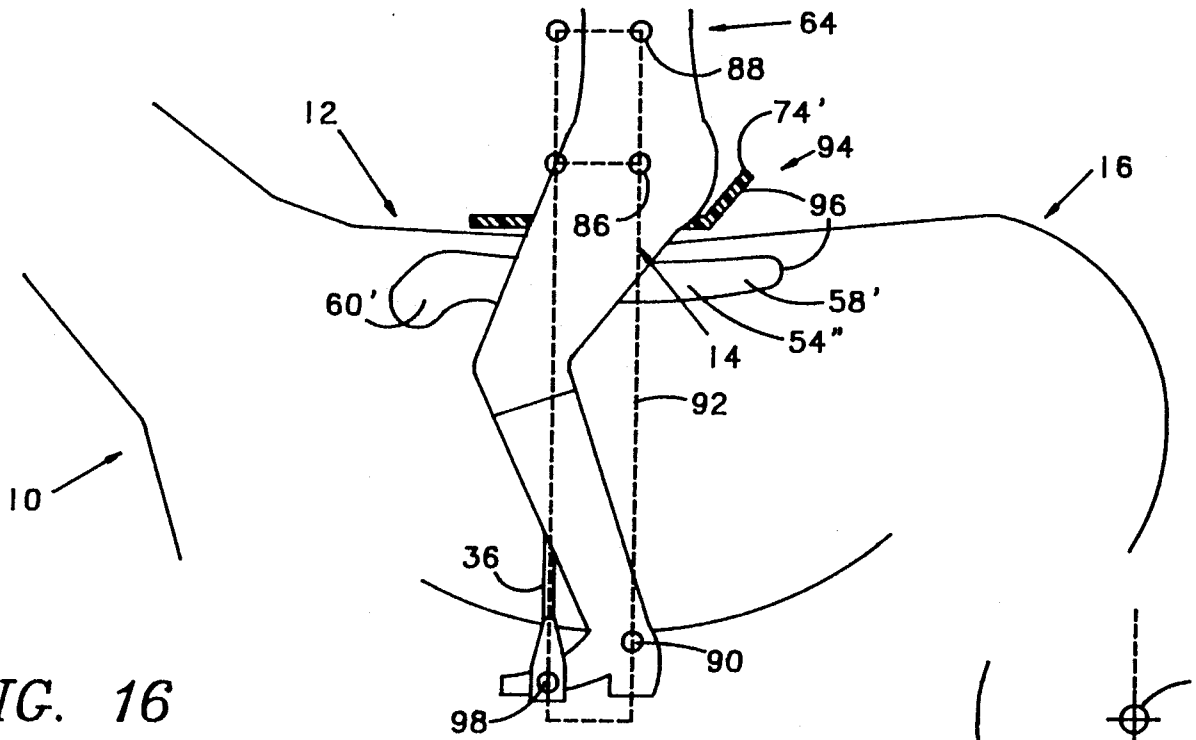
FIG. 16 is a simplified partial side view of a horse as in FIG. 1 showing the elements of a saddle and saddle tree according to the present invention as they relate to a rider on the horse.
Figure 17:
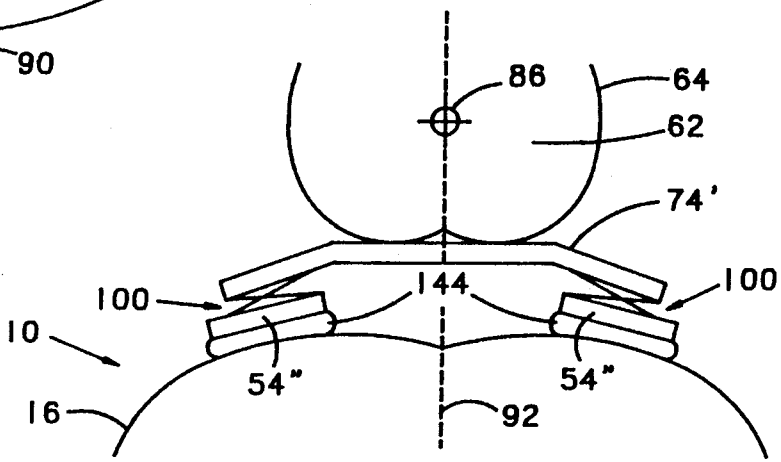
FIG. 17 is a simplified rear view of a rider on a saddle according to the present invention sitting on a horse's back showing the elements of a saddle and saddle tree according to the present invention.
Figure 20:
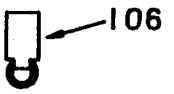
FIG. 20 is a detailed plan view drawing of attaching fixtures employed in the saddle of the present invention.

Referring first briefly to FIGS. 16 and 17, the principles upon which the present invention are based are depicted therein. According to now well-accepted principles, when riding correctly, the rider 64 is said to be "centered"; that is, the rider's center of gravity 86, mid-torso 88, head (not shown), and ankle bone 90 lie along a common vertical line 92. Orthopedically for the horse 10, it is best if the vertical line 92 passes through the low point 14 of the horse's back. This is the "natural" saddle position mentioned earlier. Some of the greatest horsemen in the world rode without saddles. These "bareback" horsemen sat in this natural position as they knew that if they sat anywhere else, ultimately they would end up there. Thus, the saddle 94 and saddle tree 96 of this invention are designed such that the bars 54" will retain the saddle tree 96 adjacent the low point 14 with the front portions 60' behind the horse's shoulder blades. Also, the seat portion 74' is attached to the bars 54" so as to position the center one-third of the saddle 94 over the low point 14. As depicted in FIG. 16, for anatomical correctness, the stirrup straps 36 are attached to the seat portion 74' at a distance forward of the vertical line 92 about equal to the distance from the ankle bone 90 to the ball of the foot 98. Thus, when the rider 64 stands in the stirrups of the saddle 94, there is virtually no longitudinal change in the rider's center of gravity 86.

Further objects are obtained by constructing the saddle 94 and its tree 96 so that the seat portion 74' is elastomerically connected to the bars 54". Thus, the bars 54" can be constructed with an eye to durability since the desired and required flexibility and adaptability is provided by the individual components rather than a combination as in the prior art. Additionally, the undersides of the bars 54" where they sit on the horse's back employ dynamically-adapting padding 144 rather than batting or the like as in the prior art. Also, as depicted in FIG. 17, in its preferred embodiment, the seat portion 74' is virtually flat both longitudinally and laterally about the center where the rider's buttocks 62 are placed and under the rider's center of gravity 86. This is particularly important in the longitudinal direction (typically completely overlooked in saddle design) as only on a level surface can the rider properly roll his/her pelvis fore and aft on the buttocks 62 in a natural riding motion. If the rider is sitting with a saddle seat which is facing up hill or down hill rather than level, this natural pelvic rocking motion is defeated.

Turning first to FIGS. 18 through 27, the saddle 94 and its saddle tree 96 in a configuration intended for affording the horse maximum protection and comfort during long hours under saddle will now be described in detail. While the components of tested embodiments have been made of laid-up fiberglass employing glass cloth and resin in the usual manner, the design and manner of operation of the saddle tree 96 is such that other materials such as a tough plastic could also be used if desired; and, in fact, would probably be preferable for production in large quantities as by an injection molding process or the like rather than individual, hand-made construction.

Figure 18:
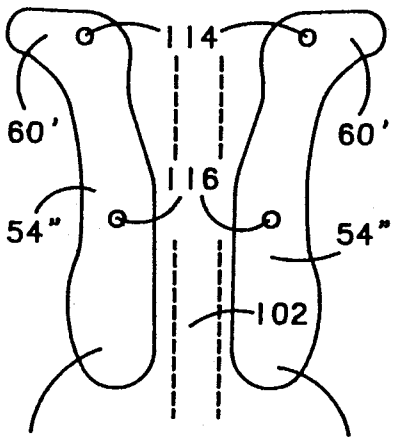
FIG. 18 is a detailed plan view drawing of the bar portions of a saddle tree according to the present invention in an embodiment intended to provide maximum comfort for a horse over long periods of use.
Figure 21:
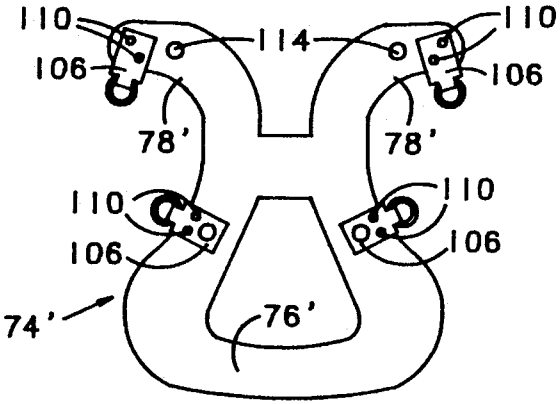
FIG. 21 is a detailed plan view drawing showing the seat portion of FIG. 19 with the attaching fixtures of FIG. 20 attached thereto.

The bars 54" are shown in FIG. 18. As can be seen by comparison to the Gorenschek bars 54' of FIG. 13, the bars 54" of this invention comprise shortened rear portions 58' designed to lie parallel along the spine 102 of the horse. The front portions 60' are also abbreviated with only a slight downward bend so as to conform to the horse's neck adjacent the withers 12.

Figure 19:
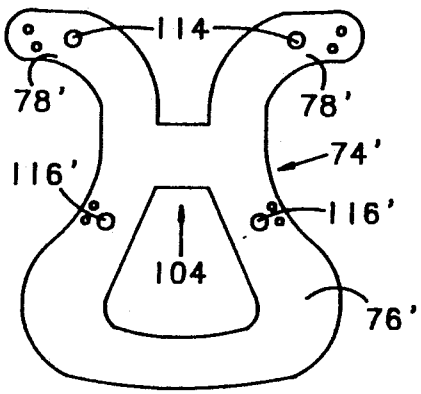
FIG. 19 is a detailed plan view drawing of the seat portion of the saddle of the present invention.

The seat portion 74' as depicted in FIG. 19 is broader and deeper in the rear portion 76' and shaped so as to provide the longitudinally and laterally level area 104 for the rider's buttocks 62 under his/her center of gravity 86 adjacent the center as mentioned above. The front portions 78' are sized and shaped to be in keeping with the front portions 60' of the bars 54".

The assembly of the saddle tree 96 will now be described. As those skilled in the art will readily recognize and appreciate, the padding and leather covering will be added to the components prior to assembly in some cases. In the interest of clarity, however, the covering process is omitted from the assembly discussion. This aspect is well known to those skilled in the art and to include it would detract from the points of novelty being addressed.

Figure 22:
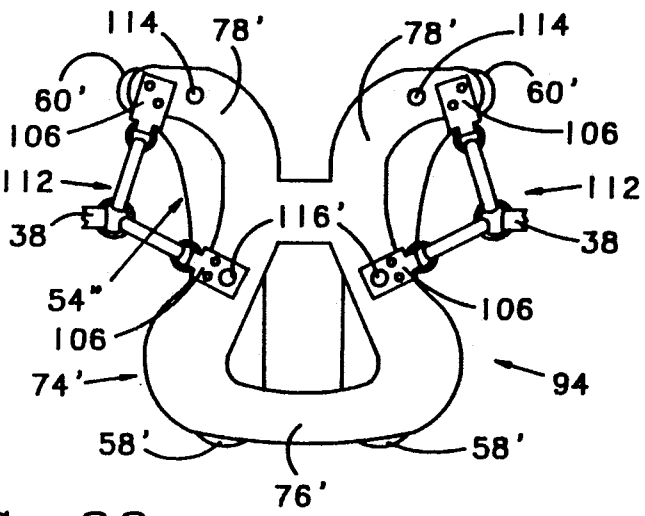
FIG. 22 is a detailed plan view drawing showing the seat portion of FIG. 19 with the bars of FIG. 18 attached thereto and depicting how the attaching fixtures are used to attach a girth harness thereto.
Figure 23:
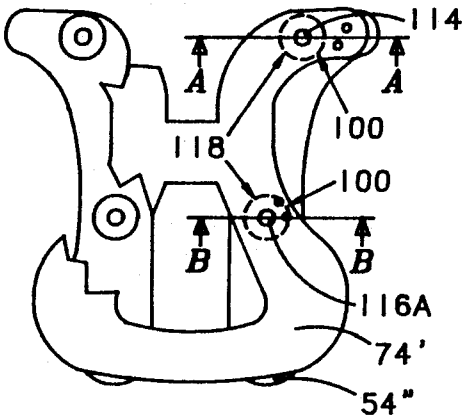
FIG. 23 is a partially cutaway plan view drawing of the assembled apparatus of FIG. 22 showing the elastomeric bushings employed to connect the bars to the seat portion.

The fixture rings 106 are attached to the holes 110 as depicted in FIG. 23 using rivets, screws, bolts, or the like. A girth connecting harness 112 of a conventional nature is then connected to the fixture rings 106 and the seat portion 74' is mounted to the bars 54'' as depicted in FIG. 22 in the manner now to be described in detail. Before doing so, however, the objective to be achieved will first be described. As will be remembered from the discussion of the Gorenschek saddle above, in that saddle the front portions 60' and front portions 78 had to be able to flex in combination; and, could not do so without ultimate failure of the material. In the saddle of this invention, the front portions 60' and front portions 78' flex individually and flexure of a front portion 60' from upward movement of the horse's shoulderblade is passed through to flex the corresponding front portion 78' by the non-rigid elastomeric connection 100 between the two. The elastomeric connection 100 also allows the bars 54'' and the seat portion 74' to individually flex and move to aid in conforming to the shape of the horse's back—both statically and dynamically.

Figure 25:
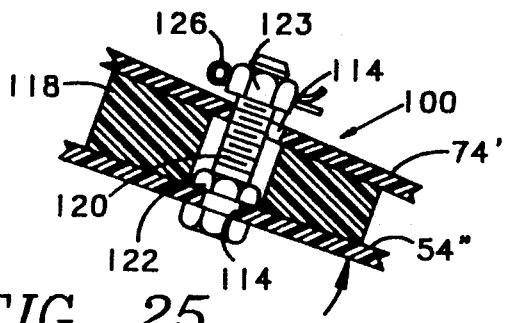
FIG. 25 is a partially cutaway drawing of the apparatus of FIG. 23 in the plane A—A showing how the front bushing allows the bars to move and rotate.
Figure 24:
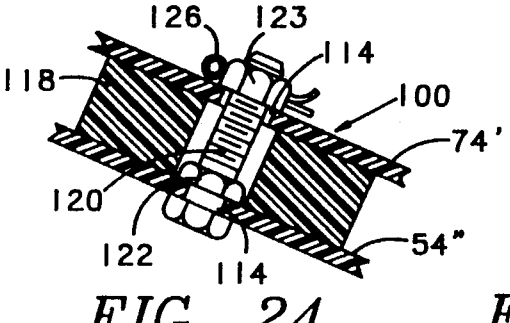
FIG. 24 is a partially cutaway drawing of the apparatus of FIG. 23 in the plane A—A in its relaxed state following assembly.

As depicted in FIG. 23, the seat portion 74' is mounted to the bars 54'' at front holes 114 and rear holes 116 employing elastomeric connections 100 as previously mentioned. The front elastomeric connection 100 is depicted in FIGS. 24 and 25 in non-compressed and compressed conditions, respectively. A generally annular bushing 118 of silicone foam is concentrically disposed about each of the matching front holes 114 between the seat portion 74' and the bars 54''. While other types of closed-cell foam or the like as known in the art can be employed, silicone foam is preferred because it will take a "set" when compressed to a particular position. Thus, when the saddle 94 is placed on a horse's back, the bars 54'' will shift and compress the silicone foam of the bushing 118 to assume an adapted set position while still allowing further flexing and compressing during dynamic motion. Thus, the elastomeric connections 100 are automatically adjustable both statically and dynamically.

A through-bolt 120 is passed through the front holes 114 and the bushing 118. The through-bolt 120 is held gripping the bars 54'' by a first nut 122 and the seat portion 74' is held against the bushing 118 by a second nut 123. The second nut 123 is prevented from coming loose by a cotter pin 126; but, a self-locking nut could also be employed. The use of the through-bolt 120 is preferred and employed for maximum stability and security against the seat portion 74' shifting or separating from the bars 54''. While not preferred, the bushing 118 could be a solid disk (or other shape) and could be attached to the seat portion 74' and the bars 54'' with one of the high-strength adhesives commercially available, such as those sold by Kodak. Again while not preferred, the bushing 118 could also be employed to change the initial slope angle of the bars 54'' rather than relying solely on the compressibility of the silicone foam. For example, rather than being of equal thickness throughout, the bushing 118 could slope from a quarter inch in thickness on one side to three quarters of an inch in thickness on the opposite side. Then, depending upon the orientation of the bushing 118 when placed between the seat portion 74' and the bars 54'', a rotational difference in orientation of one inch can be effected. As depicted in FIG. 25, when the underlying bar 54'' is rotated and/or compressed as indicated by the arrow, the through-bolt 120 rises up through the upper front hole 114 and the bushing 118 is compressed.

Figure 26:
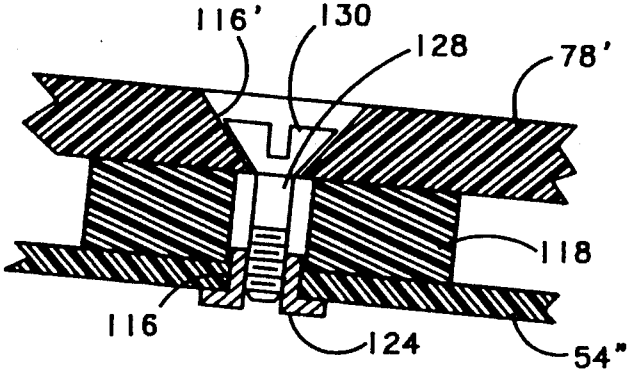
FIG. 26 is a partially cutaway drawing of the apparatus of FIG. 23 in the plane B—B in its relaxed state following assembly and depicting the rear bushing which also allows the bars to move and rotate.

While the through-bolts 120 can be employed at the front holes 114 because they are covered with padding and any upward movement of through-bolts 120 will not cause problems, the rear holes 116 are under the rider's buttocks 62 and, therefore, a different method of securing the bushing 118 must be employed. Also, it should be noted that the use of an elastomeric connection at the rear position under the rear portion 76' is optional as the majority of the static and dynamic movement takes place at the front portions 78'. As depicted in FIG. 26, a captive nut 124 is held by the rear hole 116 in the bar 54''. The rear portion 78' at that point is relatively thick (18–20 ply fiberglass) as it must support the rider's weight without flexing. Accordingly, a countersunk rear hole 116', made therein. A large-headed machine screw 128 is then threaded through the hole 116' and the bushing 118 into the captive nut 124 to hold the pieces together. The head 130 cannot pull through the countersunk rear hole 116', but is free to rise up as necessary to allow for compression of the bushing 118 by the bar 54''.

It is contemplated that one may want to use the elastomeric connections 100 at the front and rear and to made the machine screws 128 and the second nuts 123 accessible so that the bars 54'' can be removed and the bushings 118 changed as necessary.

Figure 27:
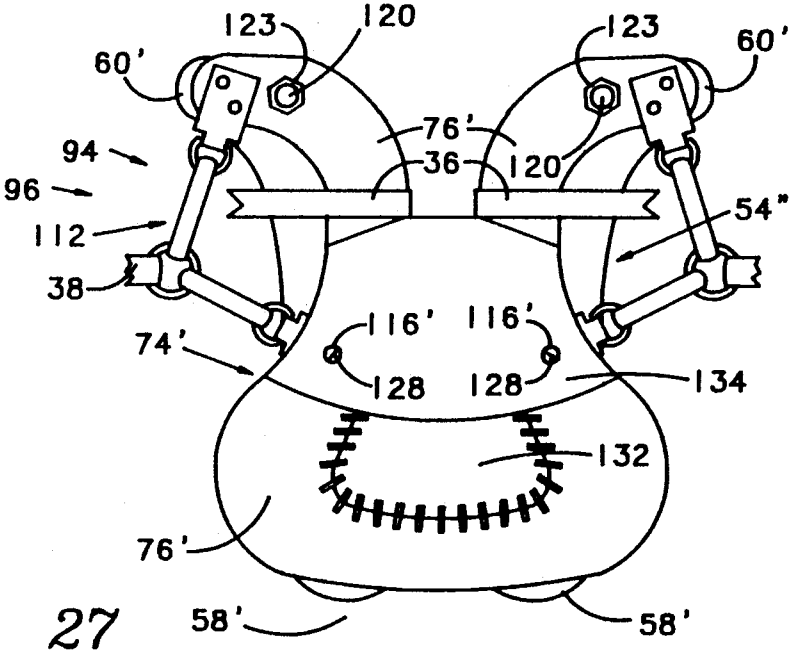
FIG. 27 is a detailed plan view drawing of the saddle of the present invention in one embodiment of the seat and manner of attaching the girth and stirrups prior to being covered with padding and a covering material.

The completed saddle 94 (less padding and covering leather) is depicted in FIG. 27. As can be seen therein, the open center of the rear portion 78' of the seat portion 74' has a leather filler piece 132 stitched therein and a covering leather piece 134 adhesively attached over the center portion. This aspect is conventional to saddle construction. If desired, the open center of the rear portion 78' can be omitted and the rear portion 78' made as one solid piece as in the embodiment of FIG. 28. Because of the various foam materials now available, the original reasons for the leather filler piece 132 are no longer applicable. As will be noted from FIG. 27, the stirrup straps 36 are attached around the front portions 76' of the seat portion 74'. By fastening the stirrup straps 36 to the front portions 76' instead of to the bars 54' as in the Gorenschek saddle, the serious problems of the Gorenschek saddle related thereto as described above have been eliminated. Any deformation of the front portions 76' caused by rider weight on the stirrup straps is taken up by deformation and compression of the bushings 118 and not passed through to the bars 54''. Thus, the elastomeric connections 100 implemented with the bushings 118 effect a bi-directional isolation between the horse, rider, and saddle.

Figure 28:
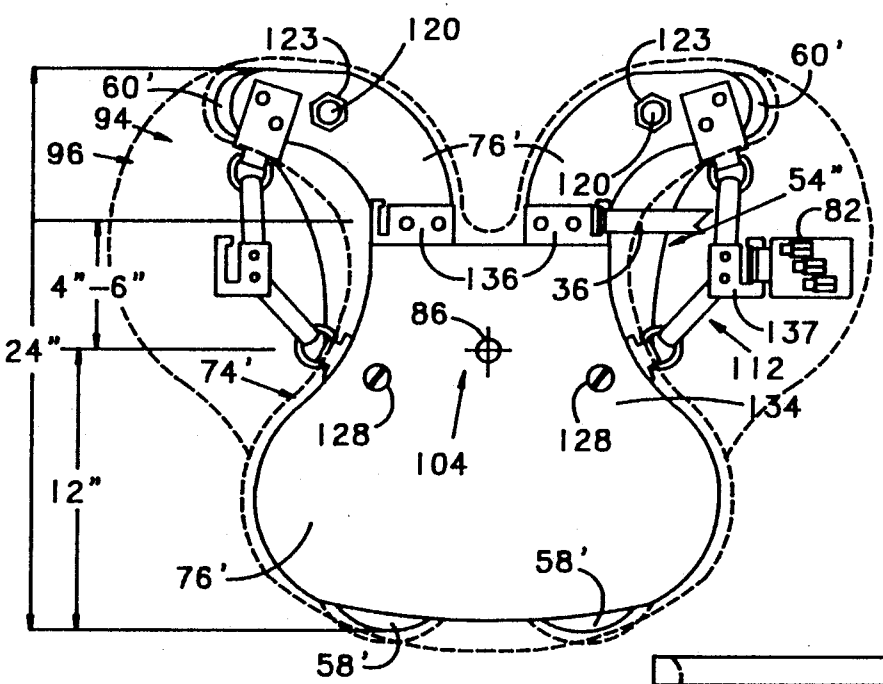
FIG. 28 is a detailed, plan view drawing of the saddle of the present invention in a second embodiment of the seat and preferred manner of attaching the girth and stirrups with the padding and covering material depicted in ghosted form.

Turning now to FIG. 28 the saddle 94 of the present invention as built on the saddle tree 96 is shown therein along with the nominal dimensions to attain the desired objectives. As previously employed in the drawing figures, the leather coverings and skirts are indicated by the dashed lines labelled 34. The overall length of the completed saddle 94 is about twenty-four inches and the center of the middle of the level area 104 (through which the vertical line 92 passes and over which the center of gravity 86 of the rider is positioned) is placed substantially in the center of the saddle 94 at twelve inches from either end. For ease of changing, it is preferred that a pair of hooked stirrup leather holders 136 of a suitable metal (such as stainless steel) be wrapped around and connected to the front portions 76' with screws or rivets. The hooked stirrup leather holders 136 are positioned to place the stirrup straps 36 attached thereto (and thereby the stirrup "irons"-not shown) at the desired ankle bone to ball-of-foot position from the center of gravity point 86. Typically, in a woman's saddle this distance is about three to four inches while for a man's saddle it is four to six inches. Similarly, a pair of hooked girth billet holders 137 of a suitable metal (such as stainless steel) are attached to the girth connecting harness 112 so that girth billets 82 can be releasably attached thereto.

Figure 29:
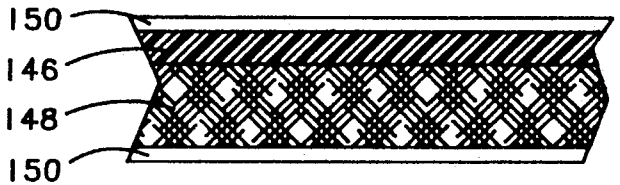
PRIOR ART FIG. 29
FIG. 29 is a cutaway drawing through one of the bars of the prior art saddle of FIGS. 13-15.

As mentioned earlier herein, the third and final aspect of the saddle of this invention which provides the total package of benefits in its best mode is the padding to the bars 54". As those skilled in the art will recognize and appreciate, the bars 54" will normally be covered with a skirting material which extends beyond the bars 54" for various esthetic and functional reasons not related to the present invention. Accordingly, the unique padding of the bars 54" to provide the dynamic conformance features desired will be described with relation to the bars 54" alone. As shown in FIG. 29, the prior art Gorenschek saddle as described above employed bars 54' comprising the fiberglass 146 of the bars 54' themselves having a batt 148 of padding disposed over the surface of the fiberglass 146 facing the horse's back with the two components (i.e. fiberglass 146 and batt 148) within a covering 150. The covering could be cloth, leather, sheepskin, or a combination thereof (one on top and one on the bottom facing the horse). The batt 148 of padding is typically of horsehair, pig bristles, or the like, as has been used for such purposes since early times. The problem with such padding is that it is dynamically stable. Even if the bars 54' of the Gorenschek saddle were fitted precisely to the horse by adjusting the padding of the batt 148 (as was actually done), the fit to a standing horse is not the same as that to a dynamic horse.

Figure 30:
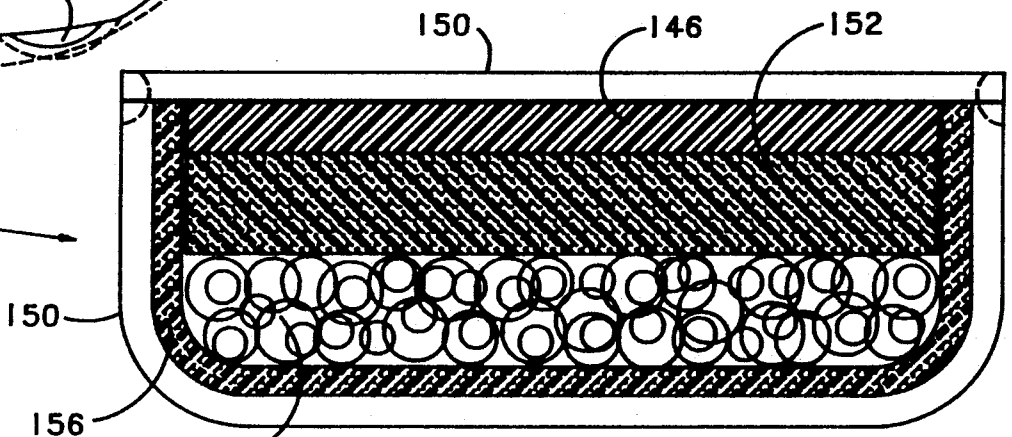
FIG. 30 is a cutaway drawing through one of the bars of a saddle according to the present invention showing the unique manner of padding to effect dynamic conformance to the shape of the horse at an intermediate gate.

In the preferred implementation of a saddle according to the present invention, the bars 54" are padded in the manner shown in FIG. 30. The applicant herein has found that when the approach of FIG. 30 is employed, bars 54" that fit the back of the horse perfectly when standing no longer fit perfectly after the saddle has been used for a while. This is because the padding of the bars 54" dynamically shifts in use to conform to the horse's back as it is under the most normal use; that is, to the shape of the horse's back somewhere between a walk and a trot. Thus, in use, the saddle 94 and its bars 54" most closely fit the back of the horse during the time of interest—in use with the weight of a rider on the horse's back. To accomplish this result, the padding comprises an under layer of between one-half inch and one inch of a foam material 152 adhesively bonded to the fiberglass 146 to prevent its shifting under the dynamic forces. The preferred foam material 152 is one sold under the tradename Armaflex. Over the foam material 152 is placed a layer of unbonded upholstery Dacron of about the same thickness. It is important that the upholstery Dacron be unbonded (i.e. not in a batt form); but rather, as individual balls 154 of the Dacron material. While Dacron is the material of choice, any upholstery stuffing material exhibiting like qualities can be used. A 3/16 inch layer of neoprene 156 covers the individual balls 154 of the Dacron material to act as a flexible protective layer for the outside covering 150 which, like the prior art, can comprise cloth, leather, sheepskin, or a combination thereof. In motion, the horse's back flexes and moves as described earlier herein. As it does, the foam material 152 and the neoprene 156 compressibility and restoratively move in response to the motions. As a result of these dynamic forces, like a saddle which will move to the low point of the horses back as the horse moves, the balls 154 of the Dacron material are shifted, moved, and compressed to fill in low places and thereby dynamically shape to the horse's back at the times of greatest dynamic forces.

As can be appreciated from the drawings and the description above, when the leather coverings and skirts indicated by the dashed lines 34 are added, the saddle 94 of this invention is strong, lightweight, visually pleasing, automatically adjusts to both the static and dynamic needs of the horse, and is anatomically correct for the rider.

Wherefore, having thus described the present invention, what is claimed is:

1. A statically and dynamically self-adjusting and orthopedically-correct saddle comprising:

a) a pair of flat resiliently-flexible first bars each having a rear portion disposed to lie on a horse's back along opposite sides of the horse's spine and generally parallel thereto and a front portion disposed to follow a curve from said rear portion down and alongside the horse's withers;

b) a seat portion comprising a rear portion including a seat and a cantel and a front portion comprising a pair of flat resiliently-flexible second bars extending forwardly from said seat, said seat portion being positioned with said second bars disposed over and parallel to said front portion of respective ones of said first bars, said seat portion further being attached to said pair of first bars at respective first points located in said rear portion and respective second points located in said front portion, said seat being positioned in a middle one-third of the saddle with a center point thereof under a center of gravity of a rider sitting thereon over a low point in the horse's back;

c) a pair of first elastomeric members connecting said seat portion to said first bars at respective ones of said second points wherein said first elastomeric members possess sufficient elasticity to allow the first bars to be rotatable about a pair of mutually orthogonal axes lying in a plane generally parallel to the seat portion at said second points;

d) a girth;

e) a pair of stirrup straps;

f) means for attaching said girth to the saddle carried by said seat portion; and, g) means for attaching said pair of stirrup straps to respective ones of said pair of flat second bars.

2. The statically and dynamically self-adjusting and orthopedically-correct saddle of claim 1 wherein:

said means for attaching said pair of stirrup straps to respective ones of said pair of flat second bars attaches said pair of stirrup straps at a distance in front of said center of gravity of a rider equal to a distance between said rider's ankle and ball of said rider's foot.

3. The statically and dynamically self-adjusting and orthopedically-correct saddle of claim 1 and additionally comprising:

a pair of second elastomeric members connecting said seat portion to said pair of first bars at respective ones of said first points.

4. The statically and dynamically self-adjusting and orthopedically-correct saddle of claim 3 wherein:
said first elastomeric members and said second elastomeric members are of a silicone foam material.

5. The statically and dynamically self-adjusting and orthopedically-correct saddle of claim 1 wherein:
said first elastomeric members are of a silicone foam material.

6. The statically and dynamically self-adjusting and orthopedically-correct saddle of claim 1 wherein:
said first elastomeric members are adhesively attached to said seat portion and said pair of first bars.

7. The statically and dynamically self-adjusting and orthopedically-correct saddle of claim 1 wherein:
a) said first elastomeric members are annular in shape; and additionally comprising,
b) retaining means passing through each of said first elastomeric members for attaching and retaining said first elastomeric members between said seat portion and said pair of first bars.

8. The statically and dynamically self-adjusting and orthopedically-correct saddle of claim 1 wherein:
said first elastomeric members are thinner adjacent a first edge than adjacent a second edge opposite said first edge whereby an angular relationship between said seat portion and said pair of first bars is adjustable by rotationally orienting said first elastomeric members.

9. The statically and dynamically self-adjusting and orthopedically-correct saddle of claim 1 wherein:
a) said means for attaching said girth comprises a pair of metal hooks to which a girth billet is attached; and,
b) said means for attaching said pair of stirrup straps comprises a pair of metal hooks to which stirrup leathers are attached.

10. The statically and dynamically self-adjusting and orthopedically-correct saddle of claim 1 wherein each of said first bars is covered on a side facing the horse's back with:
a) an under layer of a foam material adhesively bonded to the first bar;
b) a layer of individual balls of unbonded upholstery material exhibiting the qualities of Dacron disposed over said under layer;
c) a layer of neoprene disposed over said layer of individual balls of unbonded upholstery material to contain said layer of individual balls of unbonded upholstery material in a compartment formed of said layer of neoprene and said under layer of foam material; and,
d) an outside covering over said first bar on one side and over said layer of neoprene on an opposite side, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

11. A statically and dynamically self-adjusting and orthopedically-correct saddle comprising:
a) a pair of flat resiliently-flexible first bars each having a rear portion disposed to lie on a horse's back along opposite sides of the horse's spine and generally parallel thereto and a front portion disposed to follow a curve from said rear portion down and alongside the horse's withers;
b) a seat portion comprising a rear portion including a seat and a cantel and a front portion comprising a pair of flat resiliently-flexible second bars extending forwardly from said seat, said seat portion being positioned with said second bars disposed over and parallel to said front portion of respective ones of said first bars, said seat portion further being attached to said pair of first bars at respective first points located in said rear portion and respective second points located in said front portion, said seat being positioned in a middle one-third of the saddle with a center point thereof under a center of gravity of a rider sitting thereon and over a low point in the horse's back;
c) a pair of first elastomeric members connecting said seat portion to said pair of first bars at respective ones of said second points;
d) a pair of second elastomeric members connecting said seat portion to said pair of first bars at respective ones of said first points, said first elastomeric members and said second elastomeric members being of a silicone foam material;
e) a girth;
f) a pair of stirrup straps;
g) means for attaching said girth to the saddle carried by said seat portion; and,
h) means for attaching said pair of stirrup straps to respective ones of said pair of flat second bars at a distance in front of said center of gravity of a rider equal to a distance between said rider's ankle and ball of said rider's foot; wherein,
i) said first elastomeric members and said second elastomeric members are annular in shape; and additionally comprising,
j) retaining means passing through each of said first elastomeric members and said second elastomeric members for attaching and retaining said first elastomeric members and said second elastomeric members between said seat portion and said pair of first bars; and wherein additionally,
k) each of said first bars is covered on a side facing the horse's back with,
k1) an under layer of a foam material adhesively bonded to the first bar,
k2) a layer of individual balls of unbonded upholstery material exhibiting the qualities of Dacron disposed over said under layer,
k3) a layer of neoprene disposed over said layer of individual balls of unbonded upholstery material to contain said layer of individual balls of unbonded upholstery material in a compartment formed of said layer of neoprene and said under layer of foam material, and
k4) an outside covering over said first bar on one side and over said layer of neoprene on an opposite side, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

12. A statically and dynamically self-adjusting and orthopedically-correct saddle tree comprising:

a) a pair of flat resiliently-flexible first bars each having a rear portion disposed to lie on a horse's back along opposite sides of the horse's spine and generally parallel thereto and a front portion disposed to follow a curve from said rear portion down and alongside the horse's withers;

b) a seat portion comprising a rear portion including a seat and a cantel and a front portion comprising a pair of flat resiliently-flexible second bars extending forwardly from said seat, said seat portion being positioned with said second bars disposed over and parallel to said front portion of respective ones of said first bars, said seat portion further being attached to said pair of first bars at respective first points located in said rear portion and respective second points located in said front portion, said seat being positioned in a middle one-third of the saddle with a center point thereof under a center of gravity of a rider sitting thereon over a low point in the horse's back;

c) a pair of first elastomeric members connecting said seat portion to said first bars at respective ones of said second points wherein said first elastomeric members possess sufficient elasticity to allow the first bars to be rotatable about a pair of mutually orthogonal axes lying in a plane generally parallel to the seat portion at said second points;

d) a means for attaching a girth carried by said seat portion; and, e) means for attaching a pair of stirrup straps to respective ones of said pair of flat second bars.

13. The statically and dynamically self-adjusting and orthopedically-correct saddle tree of claim 12 wherein:

said means for attaching a pair of stirrup straps to respective ones of said pair of flat second bars attaches said pair of stirrup straps at a distance in front of said center of gravity of a rider equal to a distance between said rider's ankle and ball of said rider's foot.

14. The statically and dynamically self-adjusting and orthopedically-correct saddle tree of claim 12 and additionally comprising:

a pair of second elastomeric members connecting said seat portion to said pair of first bars at respective ones of said first points.

15. The statically and dynamically self-adjusting and orthopedically-correct saddle tree of claim 14 wherein:

said first elastomeric members and said second elastomeric members are of a silicone foam material.

16. The statically and dynamically self-adjusting and orthopedically-correct saddle tree of claim 12 wherein:

said first elastomeric members are of a silicone foam material.

17. The statically and dynamically self-adjusting and orthopedically-correct saddle tree of claim 12 wherein:

said first elastomeric members are adhesively attached to said seat portion and said pair of first bars.

18. The statically and dynamically self-adjusting and orthopedically-correct saddle tree of claim 12 wherein:

a) said first elastomeric members are annular in shape; and additionally comprising, b) retaining means passing through each of said first elastomeric members for attaching and retaining said first elastomeric members between said seat portion and said pair of first bars.

19. The statically and dynamically self-adjusting and orthopedically-correct saddle tree of claim 12 wherein:

said first elastomeric members are thinner adjacent a first edge than adjacent a second edge opposite said first edge whereby an angular relationship between said seat portion and said pair of first bars is adjustable by rotationally orienting said first elastomeric members.

20. The statically and dynamically self-adjusting and orthopedically-correct saddle tree of claim 12 wherein:

a) said means for attaching said girth comprises a pair of metal hooks to which a girth billet is attached; and, b) said means for attaching said pair of stirrup straps comprises a pair of metal hooks to which stirrup leathers are attached.

21. The statically and dynamically self-adjusting and orthopedically-correct saddle tree of claim 12 wherein each of said first bars is covered on a side facing the horse's back with:

a) an under layer of a foam material adhesively bonded to the first bar;

b) a layer of individual balls of unbonded upholstery material exhibiting the qualities of Dacron disposed over said under layer; and, c) a layer of neoprene disposed over said layer of individual balls of unbonded upholstery material to contain said layer of individual balls of unbonded upholstery material in a compartment formed of said layer of neoprene and said under layer of foam material, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

22. A statically and dynamically self-adjusting and orthopedically-correct saddle tree comprising:

a) a pair of flat resiliently-flexible first bars each having a rear portion disposed to lie on a horse's back along opposite sides of the horse's spine and generally parallel thereto and a front portion disposed to follow a curve from said rear portion down and alongside the horse's withers;

b) a seat portion comprising a rear portion including a seat and a cantel and a front portion comprising a pair of flat resiliently-flexible second bars extending forwardly from said seat, said seat portion being positioned with said second bars disposed over and parallel to said front portion of respective ones of said first bars, said seat portion further being attached to said pair of first bars at respective first points located in said rear portion and respective second points located in said front portion, said seat being positioned in a middle one-third of the saddle with a center point thereof under a center of gravity of a rider sitting thereon and over a low point in the horse's back;

c) a pair of first elastomeric members connecting said seat portion to said pair of first bars at respective ones of said second points;

d) a pair of second elastomeric members connecting said seat portion to said pair of first bars at respective ones of said first points, said first elastomeric members and said second elastomeric members being of a silicone foam material;

e) means for attaching a girth to the saddle carried by said seat portion; and, f) means for attaching a pair of stirrup straps to respective ones of said pair of flat second bars at a distance in front of said center of gravity of a rider equal to a distance between said rider's ankle and ball of said rider's foot; wherein, g) said first elastomeric members and said second elastomeric members are annular in shape; and additionally comprising, h) retaining means passing through each of said first elastomeric members and said second elastomeric members for attaching and retaining said first elastomeric members and said second elastomeric members between said seat portion and said pair of first bars; and wherein additionally, i) each of said first bars is covered on a side facing the horse's back with, i1) an under layer of a foam material adhesively bonded to the first bar, i2) a layer of individual balls of unbonded upholstery material exhibiting the qualities of Dacron disposed over said under layer, and i3) a layer of neoprene disposed over said layer of individual balls of unbonded upholstery material to contain said layer of individual balls of unbonded upholstery material in a compartment formed of said layer of neoprene and said under layer of foam material, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

23. A saddle tree for building a statically and dynamically self-adjusting and orthopedically-correct saddle comprising:

a) support means for distributing weight along a horse's back along opposite sides of said horse's spine and generally parallel thereto in front and in rear areas adjacent a low point in said horse's back, said support means including resiliently-flexible first front portions;

b) seat means for supporting a seated rider with a center of gravity of said rider over a low point, said seat means including resiliently-flexible second front portions; and c) elastomeric connecting means disposed between said first front portions and said second front portions for supporting said seat means on said support means wherein said elastomeric connecting means exhibits sufficient elasticity to allow the first front portions to be rotatable about a pair of mutually orthogonal axes lying in a plane generally parallel to the second front portions at connection points between the first front portions and the second front portions.

24. The saddle tree of claim 23 and additionally comprising:

means for suspending a pair of stirrups at an ankle to ball-of-foot distance in front of said low point.

25. The saddle tree of claim 23 wherein:

said seat means includes a flat area surrounding said center of gravity of said rider upon which a buttocks portion of said rider is positioned when seated.

26. The saddle tree of claim 23 wherein:

said support means includes means for dynamically shaping to a horse's back at times of greatest dynamic forces.

27. The saddle tree of claim 23 wherein the saddle tree comprises:

a) a pair of flat resiliently-flexible first bars each having a rear portion disposed to lie on a horse's back along opposite sides of the horse's spine and generally parallel thereto and a front portion disposed to follow a curve from said rear portion down and alongside the horse's withers;

b) a seat portion comprising a rear portion including a seat and a cantel and a front portion comprising a pair of flat resiliently-flexible second bars extending forwardly from said seat, said seat portion being positioned with said second bars disposed over and parallel to said front portion of respective ones of said first bars, said seat portion further being attached to said pair of first bars at respective first points located in said rear portion and respective second points located in said front portion, said seat being positioned in a middle one-third of the saddle with a center point thereof under a center of gravity of a rider sitting thereon over a low point in the horse's back;

c) a pair of first elastomeric members connecting said seat portion to said first bars at respective ones of said second points wherein said first elastomeric members posses sufficient elasticity to allow the first bars to be rotatable about a pair of mutually orthogonal axes lying in a plane generally parallel to the seat portion at said second points;

d) a means for attaching a girth carried by said seat portion; and, e) means for attaching a pair of stirrup straps to respective ones of said pair of flat second bars.

28. The saddle tree of claim 27 wherein:

said means for attaching a pair of stirrup straps to respective ones of said pair of flat second bars attaches said pair of stirrup straps at a distance in front of said center of gravity of a rider equal to a distance between said rider's ankle and ball of said rider's foot.

29. The saddle tree of claim 27 and additionally comprising:

a pair of second elastomeric members connecting said seat portion to said pair of first bars at respective ones of said first points.

30. The saddle tree of claim 29 wherein:

said first elastomeric members and said second elastomeric members are of a silicone foam material.

31. The saddle tree of claim 27 wherein:

said first elastomeric members are of a silicone foam material.

32. The saddle tree of claim 27 wherein:

said first elastomeric members are adhesively attached to said seat portion and said pair of first bars.

33. The saddle tree of claim 27 wherein:

a) said first elastomeric members are annular in shape; and additionally comprising, b) retaining means passing through each of said first elastomeric members for attaching and retaining said first elastomeric members between said seat portion and said pair of first bars.

34. The saddle tree of claim 27 wherein:

said first elastomeric members are thinner adjacent a first edge than adjacent a second edge opposite said first edge whereby an angular relationship between said seat portion and said pair of first bars is adjustable by rotationally orienting said first elastomeric members.

35. The saddle tree of claim 27 wherein:

a) said means for attaching said girth comprises a pair of metal hooks to which a girth billet is attached; and, b) said means for attaching said pair of stirrup straps comprises a pair of metal hooks to which stirrup leathers are attached.

36. The saddle tree of claim 27 wherein each of said first bars is covered on a side facing the horse's back with:

a) an under layer of a foam material adhesively bonded to the first bar;

b) a layer of individual balls of unbonded upholstery material exhibiting the qualities of Dacron disposed over said under layer; and, c) a layer of neoprene disposed over said layer of individual balls of unbonded upholstery material to contain said layer of individual balls of unbonded upholstery material in a compartment formed of said layer of neoprene and said under layer of foam material, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

37. In a saddle tree for building a saddle including resiliently-flexible support bars for distributing weight along a horse's back along opposite sides of the horse's spine and generally parallel thereto and a seat carried by the support bars for supporting a seated rider thereon, the improvement for dynamically shaping the support bars to a horse's back at times of greatest dynamic forces comprising:

a) an under layer of a foam material adhesively bonded to the support bars on a side thereof facing the horse's back;

b) a layer of individual balls of unbonded upholstery material exhibiting the qualities of Dacron disposed over said under layer; and, c) a layer of neoprene disposed over said layer of individual balls of unbonded upholstery material to contain said layer of individual balls of unbonded upholstery material in a compartment formed of said layer of neoprene and said under layer of foam material, whereby, as the horse's back flexes and moves in motion, said foam material and neoprene compressibility and restoratively move in response to dynamic motions of the horse's back and said balls of the unbonded upholstery material shift, move, and compress to fill in low places and thereby dynamically shape to the horse's back at times of greatest dynamic forces.

* * * * *